United States Patent [19]

Randolph

[11] 4,322,610

[45] Mar. 30, 1982

[54] RECORDING DEVICE FOR GOLFER

[76] Inventor: Richard C. Randolph, Box 614, FPO Seattle, Wash. 98773

[21] Appl. No.: 171,808

[22] Filed: Jul. 24, 1980

[51] Int. Cl.[3] ..... G06C 27/00
[52] U.S. Cl. ..... 235/114
[58] Field of Search ..... 235/108–114

[56] References Cited

U.S. PATENT DOCUMENTS 3,268,168 8/1966 Staller et al. ..... 235/114

*Primary Examiner*—L. T. Hix
*Assistant Examiner*—Thomas H. Tarcza
*Attorney, Agent, or Firm*—Oltsch, Knoblock & Hall

[57] ABSTRACT

A recording device for computing Nassau scoring in golf. The device consists of a series of relatively rotatable score computer discs, one of which has holes receiving rotatable buttons for selective operation to compute special bets.

9 Claims, 7 Drawing Figures

RECORDING DEVICE FOR GOLFER

SUMMARY OF THE INVENTION

This invention relates to a golf score recording device which is operative to compute and record a golf score also the results of "Nassau" bets.

In some golf matches, a complicated system called Nassau-betting is utilized. Heretofore the means of calculating the golf score and the results of Nassau bets involved a complicated and time consuming series of computations. The present invention eliminates the need for such computations by recording scoring and bet results by operating a pocket size score computer as play progresses. By rotating a primary disc of the computer, the "won" and "lost" holes are recorded. Additionally, when a "press" is made, i.e. an increased bet, it can be noted by setting a selected one of a group of buttons carried by the device. Thereafter, as the primary disc is rotated to compute "won" or "lost" holes, the selected or set press buttons are automatically rotated to compute the status of "presses" made.

Accordingly it is the primary object of this invention to provide a device for recording scores for match play in golf.

Another object is to provide means of calculating the results of golf play and of the results of "presses" in Nassau-type golf bets.

Other objects will become obvious upon a reading of the following specification.

DESCRIPTION OF THE PREFERRED EMBODIMENTS

Figure 1:
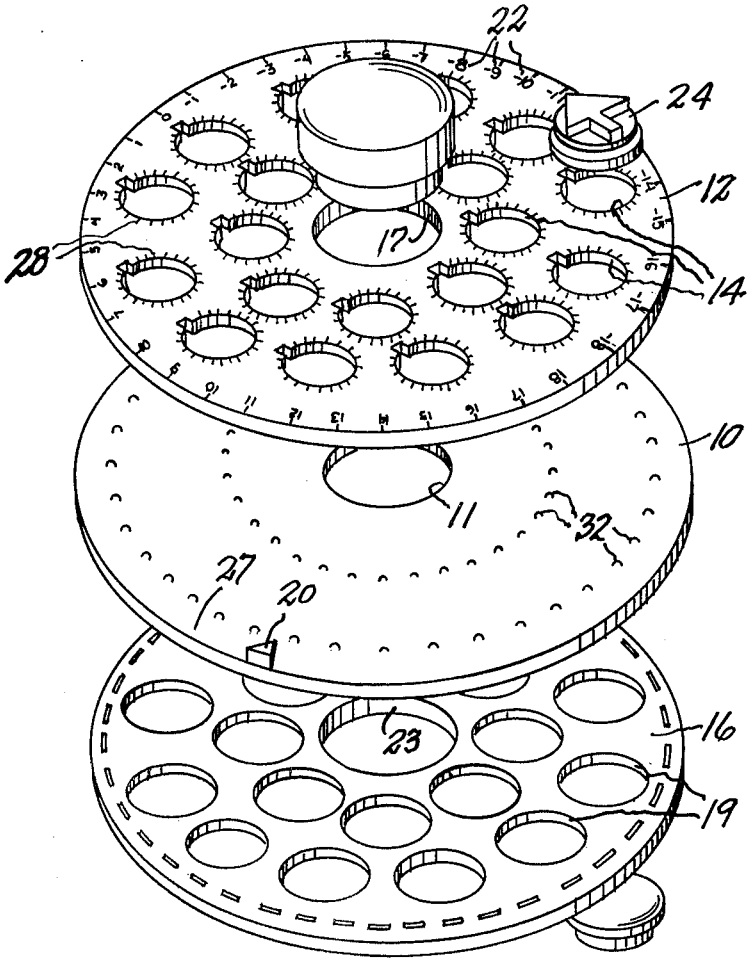
FIG. 1 is an exploded perspective view of the score recording device.
Figure 2:
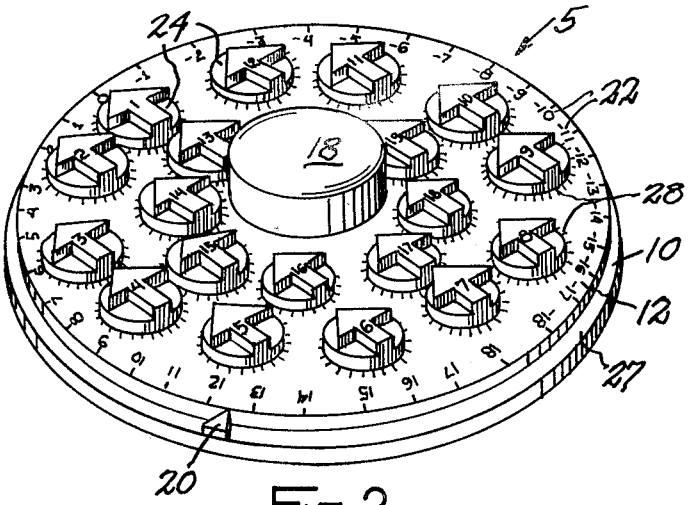
FIG. 2 is a perspective view of the assembled score recording device.

The preferred embodiments illustrated are not intended to be exhaustive or to limit the invention to the precise form disclosed. They are chosen and described in order to best explain the principles of the invention and its application and practical use to thereby enable others skilled in the art to best utilize the invention.

Referring to the drawings, scoring device 5 has three discs, an inner disc 10, upper disc 12 and lower disc 16. Upper disc 12 preferably has a downwardly projecting marginal spacer ring 13 and contains a plurality of spaced openings 14 arranged radially and circumferentially therein. Located centrally of disc 12 is a hole 17. Inner disc 10 has a hole 11 located at the center thereof. Located about the circumference of disc 10 and within a ring 13 are spaced upward projections 32 having clearance with upper disc 12. Lower disc 16 may have a plurality of openings 19 formed therein which preferably are located similarly to holes 14 of upper disc 12 and has a central hole 23.

A pin having a knob 18 is positioned in holes 17, 11, 23 when discs 10, 12 and 14 are arranged in register so as to accommodate relative rotation of selected discs. Inner disc 10 is larger than disc 12 and has a pointer 20 formed at a selected position at its peripheral margin 27, projecting outwardly relative to upper disc 12. Upper disc 12 has uniformly spaced marginal indicia 22 thereon. Upper disc 12 also has indicia 28 about each opening 14.

A button 24 is rotatably mounted within each opening 14, and each button preferably has a pointer 26 located on its upper or outer face 31. Each button 24 also has a plurality of spaced teeth 30 formed therein about the circumference of its body. Each button may have a circumferential groove 40 intermediate its ends in which a resilient ring 42 may be mounted to slightly project circumferentially from the button.

In the assembled scoring device, pin 18 extends through holes 17, 11, 23 of the superposed registering discs 10, 12 and 16, a button 24 is mounted in each opening 14. Normally the ring 42 of each button rests on upper disc 12 to position teeth 30 thereof normally clear of the projections 32 of disc 10.

Figure 3:
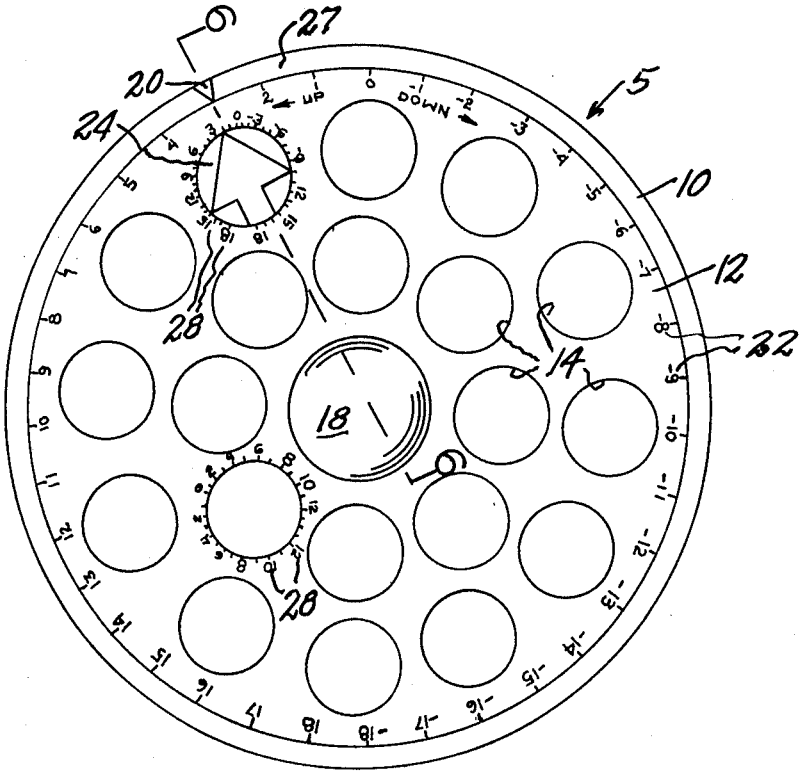
FIG. 3 is a top plan view of the score recording device with the press indicating buttons thereof removed.
Figure 4:
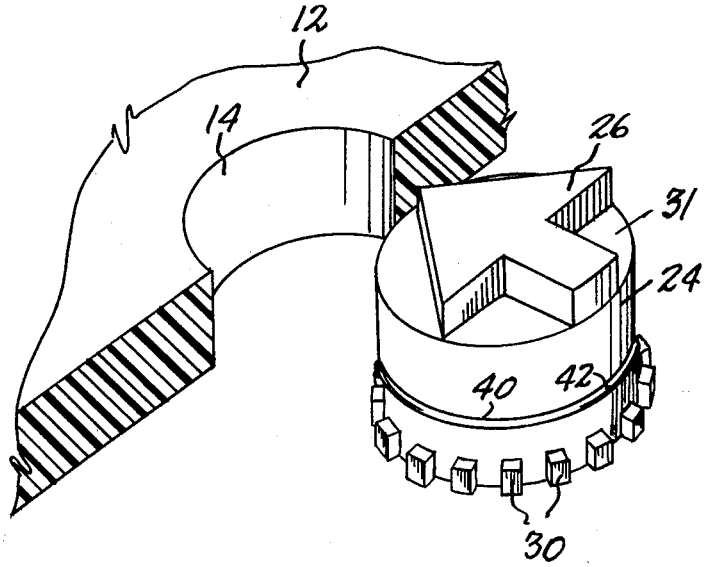
FIG. 4 is an enlarged fragmentary perspective view showing the relationship of a press button with cooperating parts of the device.
Figure 5:
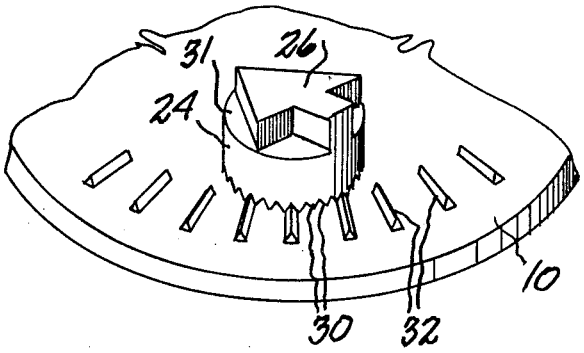
FIG. 5 is a fragmentary perspective exploded view showing the interaction of a press button with gear of a disc of the device.

In use, large inner disc 10 is successively rotated relative to upper disc 12 to move pointer 20 to successive indicia 22 on disc 12 as play proceeds so as to indicate holes won or lost or a player's score. When an increased bet or "press" is desired, a selected button 24, preferably related to a selected hole being played, is pressed inwardly to engage teeth 30 thereof with teeth 32 of inner disc 10, as accommodated by yielding of ring 42 to pass through opening 14 of disc 12. With one or more "presses" in effect, and depression of correlated buttons, when play of a hole is completed the disc 10 is rotated to advance pointer 20 one step as measured by indicia on disc 12, in a direction selected according to whether the player won or lost that hole. Upon such advance of disc 10 each depressed button 24 will be rotated by engagement of teeth 30 thereof with adjacent projections 32 on disc 10, so that the pointer 26 of each depressed button advances in correlated direction relative to adjacent indicia 28. Indicia 28 extend progressively in opposite directions from "0" as seen in FIG. 3 to indicate wins or losses.

It is understood that pointer 26 of each button 24 is normally positioned at zero relative to adjacent indicia when a bet is made and the correlated button 24 has been depressed. Rotation of inner disc 10 relative to upper disc 12 in one direction will indicate a Nassau "plus" score and rotation in the opposite direction will indicate a minus Nassau score. Further, during play of the game, rotation of inner disc 10 may record any selected multiple of indicia 22 or a single indicia. Each depressed button 24 is rotated relative to surrounding indicia 28 proportionally to the extent of rotation of inner disc 10 relative to indicia 22 of upper disc 12. Any selected button 24 may be depressed and thus brought into play after initial advance of inner disc 10 relative to the zero starting position of its surrounding indicia 28. As play continues and selected additional buttons 24 are depressed, the results of the prior and each additional press are recorded. Thus the scoring device is capable of providing a complete record and computation of each of multiple successive wagers of "presses". The total wager of each golfing round of play is determined by adding the readings of the indicia 28 adjacent all depressed buttons and of the indicia 22 indicated by the pointer 20.

Figure 6:
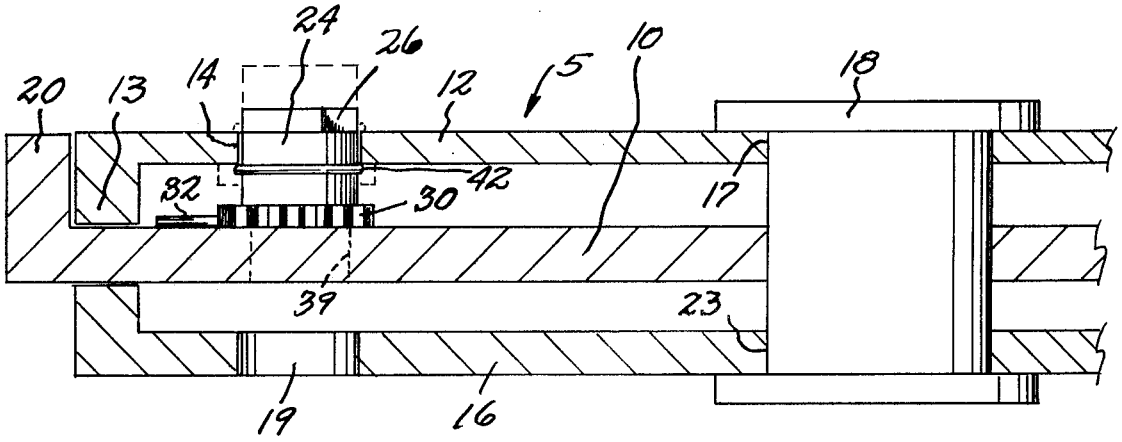
FIG. 6 is a fragmentary cross sectional view of the score recording device taken on line 6—6 of FIG. 3.
Figure 7:
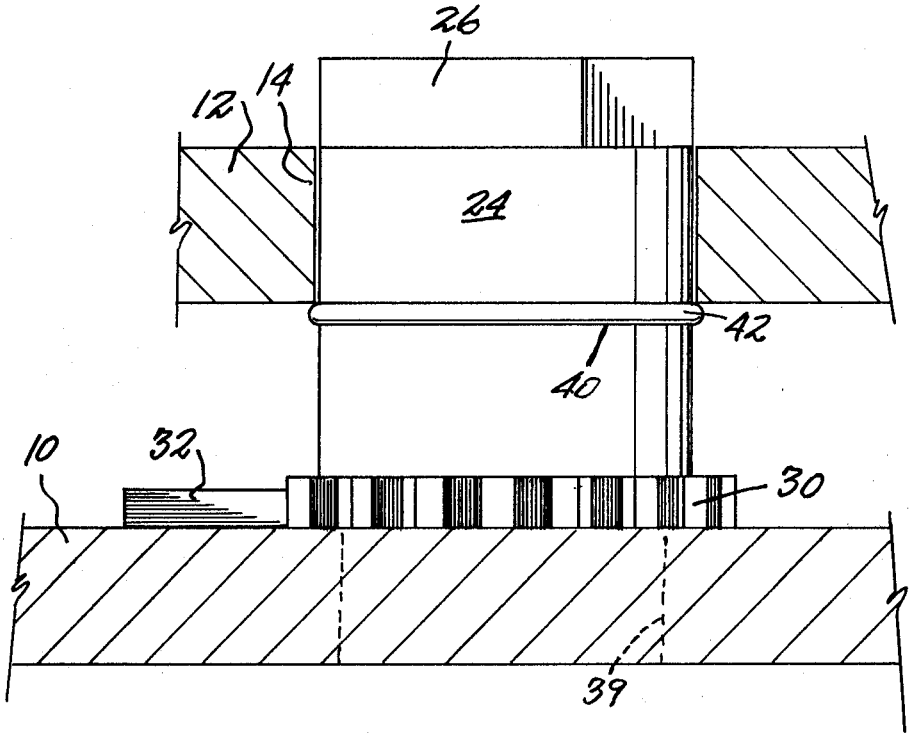
FIG. 7 is an enlarged fragmentary view of the score button in operative or recording position.

Referring to FIGS. 6 and 7, inner disc 10 may have apertures 39 formed therein (as shown by dashed lines in FIG. 6) which are substantially aligned with apertures 14 of registering disc 12 and lower disc 16. With aperture 39 at least partially aligned with a selectively depressed button 24, the button can be raised to its initial "unpressed" position by insertion of the user's finger through an aperture in lower disc 16 and an aperture 39 in disc 10 to thereby stop the computation of a bet during subsequent operation of the device. In this embodiment, button 24 has a circumferential groove 40 formed in its body. Groove 40 receives a resilient ring 42 which is located to bear on disc 12 in inoperative button position, or below disc 12, and thus hold button 24 in a selected position while permitting free rotation of each depressed button.

In cases with a lower disc 16 having openings 19 registering with holes 14 of upper disc 12, the user may insert a finger through each opening 19 registering with a button which has been depressed as a means to shift depressed buttons to a non-recording position. For this purpose, inner disc 10 may be flexible to accommodate finger pressure against depressed buttons, or may be apertured to accommodate finger insertion therein to apply pressure against the lower end of each depressed button.

What I claim is:

1. A golf scoring device comprising first and second superimposed registering discs, means journaling said discs for relative rotation, said first disc having a plurality of apertures formed therein, a plurality of buttons each positioned in an aperture of said first disc, said first disc having spaced marginal indicia, each aperture being surrounded by spaced marginal indicia, said second disc having an indicator at its projecting margin adjacent to marginal indicia of said first disc, said second disc having a circular series of equi spaced projections spaced inwardly from its margin, each button having a substantially cylindrical body journalled and axially adjustable in an aperture of said first disc and having an indicator correlated with aperture-surrounding indicia on said first disc, the inner portion of each button having a circumferential series of teeth, said buttons being normally positioned with the teeth thereof clear of the projections of said second disc and being depressible into interdigital engagement with adjacent projections, whereby rotation of said second disc relative to said first disc causes rotation of all depressed buttons by interaction of the teeth thereof with the projections of said second disc to rotatively advance said depressed buttons and thereby indicate at indicator portions of depressed buttons and at the indicator of said second disc an accrued Nassau golf score and Nassau betting result.

2. The scoring device of claim 1 wherein said journal means has a projecting knob.

3. A golf scoring device comprising a pair of superimposed concentric discs; means connecting said discs for relative concentric rotation; a first one of said discs having a plurality of spaced apertures, a circular series of indicia surrounding each aperture and a marginal series of indicia; the second of said discs having an indicator adjacent said marginal series of indicia, a button fitting rotatably and axially shiftable in each aperture and having an indicator associated with the series of indicia surrounding the aperture receiving said button, each button being selectively adjustable axially between a depressed operative position and an inoperative raised position in said apertured disc, and cooperating means on each button and said second disc engageable in the operative depressed position of a button to rotate each depressed operatively positioned button upon relative rotation of said discs.

4. A device as defined in claim 3, wherein one of said discs carries a marginal spacer ring to define a space between the portions of said discs adjacent said apertures.

5. A device as defined in claim 3, wherein said second discs is flexible to accommodate manual pressure against each depressed button to shift it from operative to inoperative position.

6. A device as defined in claim 4, wherein said second disc has apertures at least partially registering with apertures of said apertured disc to accommodate operator-finger access to the inner faces of depressed buttons to disengage and reset said previously engaged buttons.

7. A device as defined in claim 5, and a third disc having apertures substantially registering with apertures of said first named apertured disc, said second disc being positioned between said first and third discs.

8. A device as defined in claim 3, and means for maintaining each button in selected axial position relative to said second disc.

9. A device as defined in claim 7, wherein each button has a circumferential groove intermediate its length and a resilient ring seats in said groove and engages said apertured disc to maintain said button in selected axial adjustment relative to said apertured disc and said button rotating means of said second disc.

* * * * *